United States Patent [19]

Henry

[11] Patent Number: 4,718,674

[45] Date of Patent: Jan. 12, 1988

[54] GOLF STANCE AND SWING PRACTICE DEVICE

[76] Inventor: Darrell I. Henry, R.R. #1, Box 20, Westhope, N. Dak. 58793

[21] Appl. No.: 874,844

[22] Filed: Jun. 16, 1986

[51] Int. Cl.[4] ..... A63B 69/36

[52] U.S. Cl. ..... 273/186 C; 273/187 R; 273/191 R

[58] Field of Search ..... 273/186 C, 187 R, 192, 273/191 R, 191 B, 186 R

[56] References Cited

U.S. PATENT DOCUMENTS

| | | | |
|---|---|---|---|
| 3,332,688 | 7/1967 | Gevertz | 273/186 C |
| 3,638,950 | 2/1972 | Hyotlaine | 273/187 R |
| 3,870,315 | 3/1975 | Lawlor et al. | 273/186 C |
| 4,423,875 | 1/1984 | Miller | 273/192 X |

*Primary Examiner*—George J. Marlo

*Attorney, Agent, or Firm*—Harry M. Weiss & Associates

[57] ABSTRACT

The disclosure describes an improved golf training aid for practicing a variety of golf shots. The training aid is portable and fits in a golf bag. The disclosed practice device includes frame members which are arranged in a rectangular or triangular form, foot markers slidably attached to the frame, a ball placement marker, and a graduated bar which extends upwardly at an adjustable angle for measuring the golfer's backswing.

4 Claims, 7 Drawing Figures

GOLF STANCE AND SWING PRACTICE DEVICE

BACKGROUND OF THE INVENTION

1. Field of the Invention

The present invention relates generally to a device for positioning a golfer in proper relation to a golf ball for lining up any particular golf shot. Additionally, the present invention provides a means for judging the proper degree of stroke to putt, chip or pitch a golf ball any specific distance within said golfer's skill level.

2. Description of the Relative Art

Various devices have been suggested for use by a golfer in assuming and maintaining a proper stance during the golf stroke. One of the earliest is, U.S. Pat. No. 1,208,995, issued Dec. 19, 1916, to Lyon, which shows a stance instructor comprising a substantially V-shape framed including a stationary limb and a relatively movable limb. An arcuate shaped member is fixed on this stationary limb and an arrow is pivoted thereon. Connections exist between the arrow, the accurate shaped member and the moveable limbs whereby adjustment the latter is controlled by adjustment of the arrow. U.S. Pat. No. 1,517,555, issued Dec. 2, 1924, to Graham, shows a stance indicator comprising a stem having linear measurements indicated thereon with graduations commencing at one end of the stem and serving as a guide for use in resuming a position the required distance from the end of the stem. A cross-head is secured to that end of the stem at right angles thereto and provided with linear measurements as a guide in locating a ball relative to the cross-head and stem. An arm paralleling the cross-head is slidably connected to the stem for adjustment laterally toward and from the cross-head for positioning a foot of the user at the desired distance from the stem. U.S. Pat. No. 3,658,344 issued Apr. 25, 1972, to Kimble, shows a golfer's stance device comprising a linear member adapted to rest on the ground, having foot pads adjustable angularly as well as lengthwise along the linear member. Spikes anchor the foot pads in the ground. An extensible member extends laterally outward from linear member to the golf ball. The extensible member has an arm at its inner end to the midpoint of the linear member, and also has an elongated bar formed by a single strand of wire having coextensive elements shaped to provide a series of openings along its length. These openings are adapted to receive a fastener in the outer end of the arm so that the strand of wire can be connected to the arm through any one of the openings and thereby vary the length of the extensible member. U.S. Pat. No. 3,868,116 issued Feb. 25, 1975, to Ford et al., shows a golf practice device having a longitudinally extended guide portion and an inwardly turned end portion, with one of the end portions fitting over the other in a telescopic relationship. Fasteners are associated with the end portions for adjustably connecting the end portions to vary the width bewteen said longitude and extendingly guide portion. Feet or stance guide members are attached and secured to either of the longitudely extending guide members. U.S. Pat. No. 4,322,084 issued Mar. 30, 1982, to Reece et al., shows a golfer's stance device including an elongated linear frame member which mounts a pair of feet stance indicator bars. Between the feet stance indicator bars there is a slidably attached to the main frame member a ball distance indicator attachment comprising a telescope and pair of bars. At each end of the main frame member there is attached a graduated bar which slides perpindicular into the frame member. The outer end of each graduated bar includes a ball locator device which slides perpindicular thereto. Other golfer's stance devices also exist which are similar to the aforementioned, they include: U.S. Pat. No. 3,229,981 issued Jan. 18, 1966, to Taver, and U.S. Pat. No. 4,257,608 issued Mar. 24, 1981, to Funk.

In accordance with the above objects the golf stance and swing practice device of the present invention includes a plurality linear frame members of varying lengths having graduated markings thereon rotatably coupled to each other. The rotatable coupling is achieved by use of swivel clamps which allow said linear frame members to be arranged in a rectangular or triangular shape, depending upon the stance and/or stroke to be practiced. A plurality of foot position indicator markers are slidably attached to the first elongated linear frame member to indicate the proper stance, i.e., foot positioning for executing a particular stroke. One linear frame member also serves as a ball placement indicator for indicating to the golfer the position at which the ball should be placed between the golfer's feet. The graduated markings on said ball indicator also allow it to be used to perfect the degree of stroke necessary for a putt of any specific distance. Attached to the linear frame member, to the side of the golfer's back stroke, is a linear bar with graduated markings which is adjustable to create a vertical angle of any specific degree to the ground for use in establishing the correct target line for a golf shot which would be parallel to the bar in the vertical plane and the proper stroke for hitting a golf ball any specific distance. These elements can be oriented in various ways to set up any golf shots. Additionally, attached to one of the swivel clamps coupling the linear frame members is a measure for use in determining the distance a golf ball is or is to be hit using a stroke.

There is, therefore, a need for a golf stance and swing practice device which provides a means for developing proper golf techniques.

THE SUMMARY OF THE INVENTION

Accordingly, it is an object of the present invention to provide a golf stance and swing practice device which can be used to train golfers to correctly set up every conceivable type of golf shot.

It is another object of the present invention is provide a golf stance and swing practice device which can be adjusted to fit every length and type of golf club, including the putter.

It is yet another obejct of the present invention that the machine can also be adjusted to fit the height and size of any golfer.

It is still yet another object of the present invention to provide a golf stance and swing practice device to be used in practicing the proper degree of back swing for chipping, pitching or putting a golf ball a specific distance.

It is still yet another further object of the present invention to provide a golf stance machine which can be used with equal ease by both right and left handed golfers by simply assembling the machine in one of two possible orientations.

It is still yet even another further object of the present invention to provide a golf stance and swing practice device that can be easily folded so as to fit into a golfer's bag.

The foregoing and other objects, features and advantages will be apparent from the following, more particular description of the preferred embodiments of the invention as illustrated in the accompanying drawings.

DESCRIPTION OF THE PREFERRED EMBODIMENT

Figure 1:
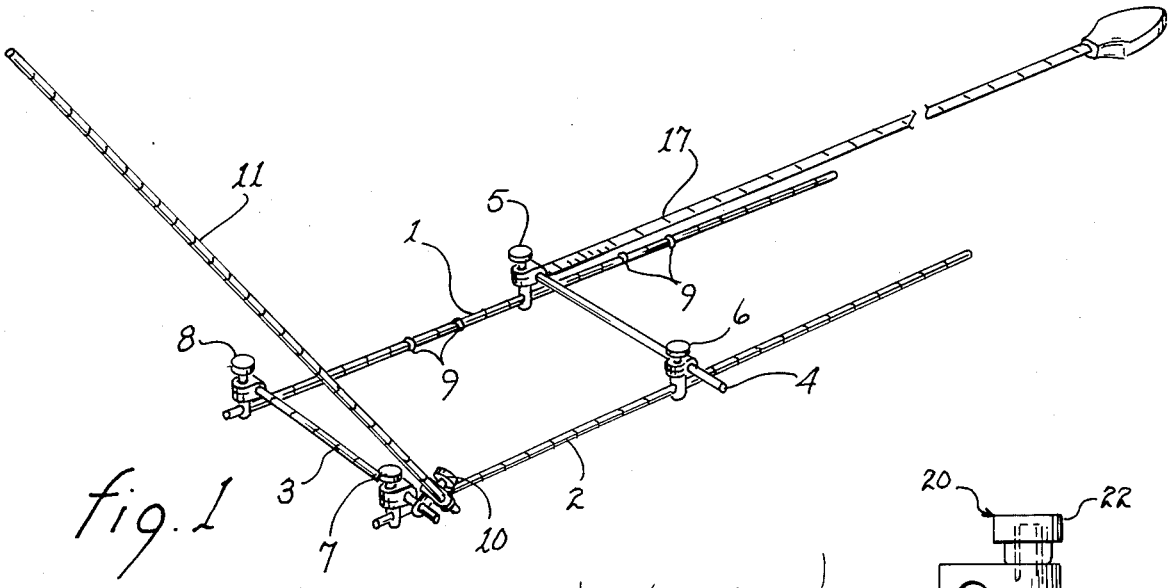
FIG. 1 is a perspective view of the golf stance and swing practice device of the present invention.

FIG. 1 illustrates the golf stance and swing practice device according to the present invention. The golf stance and swing practice device comprises a plurality of linear frame members preferably in the form of tubular bar, each having graduated markings along its length, which is laid upon the ground. In the preferred embodiment, the linear frame members 1, 2, 3 and 4 are rotatably connected to each other through use of four swivel clamps 5, 6, 7, and 8, which allow the frame to be set up to practice any type of golf shot.

A plurality of foot position indicator markers 9 are slidably attached to the first graduated linear frame member 1. Also disclosed is the use of linear frame member 4, which can be used as a ball placement indicator, as is disclosed in detail in FIGS. 3, 4, 6 and 7, and/or indicating the proper stroke during putting stance and swing practice, as is disclosed in detail in on FIG. 3. Rotatably attached, by use of another swivel clamp 10, to the third graduated linear frame member 3 is a linear bar 11. Linear bar 11 has graduated markings and is adjustable to create a vertical angle of any specific degree to the ground. Adjustment of linear bar 11 permits the correct target line for a golf shot to be established. Ideally, the correct target line would be parallel to linear bar 11 in the vertical plane. Linear bar 11 is also useful for indicating the proper degree of stroke for hitting a golf ball any specific distance. Attached to swivel clamp 5 there may be a measuring device 7, preferably a tape, for determining the distance a golf ball is or is to be hit using a particular stroke.

Figure 2:
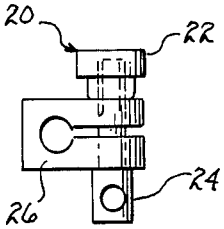
FIG. 2 is a top view of the swivel clamps used to rotatably connect the linear frame members.

FIG. 2 is a top view of the swivel clamps 20 used to rotatably connect the linear frame members 1, 2, 3 and 4 and vertical linear bar 11. Swivel clamps 20 comprise a pivot member 24 having an aperture passing therethrough for receivably mounting one of linear frame members 1, 2, 3 or 4. Pivot member 24 is pivotably coupled to clamping member 26 having an aperture passing therethrough for receivably mounting one of linear frame members 1, 2, 3 or 4. Clamping member is tightened or released by tightening means 22 which is operably disposed at an end of pivot member 24. Tightening means 24 is preferably a tightening mechanism such as a thumb-screw.

Figure 3:
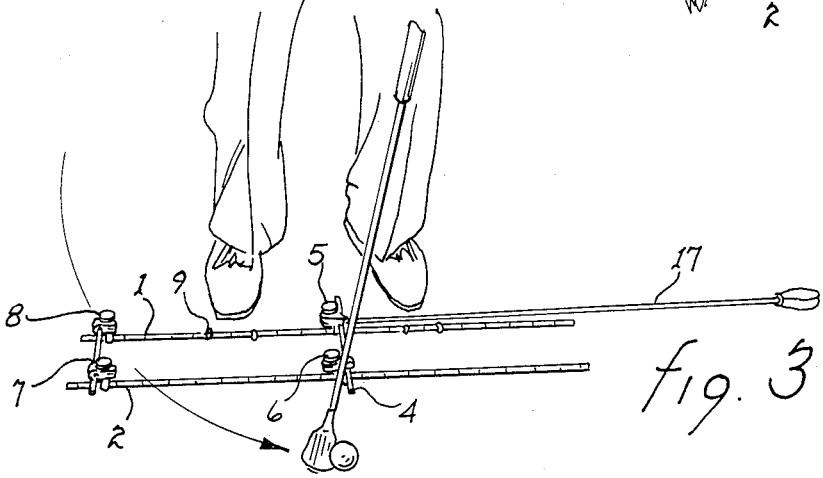
FIG. 3 is a front planar view showing the golf stance and swing practice device set up for executions drives and all other full swing shots.

FIG. 3 is a front planar view showing the golf stance and swing practice device set up for the executing drives and all full swing shots.

Figure 4:
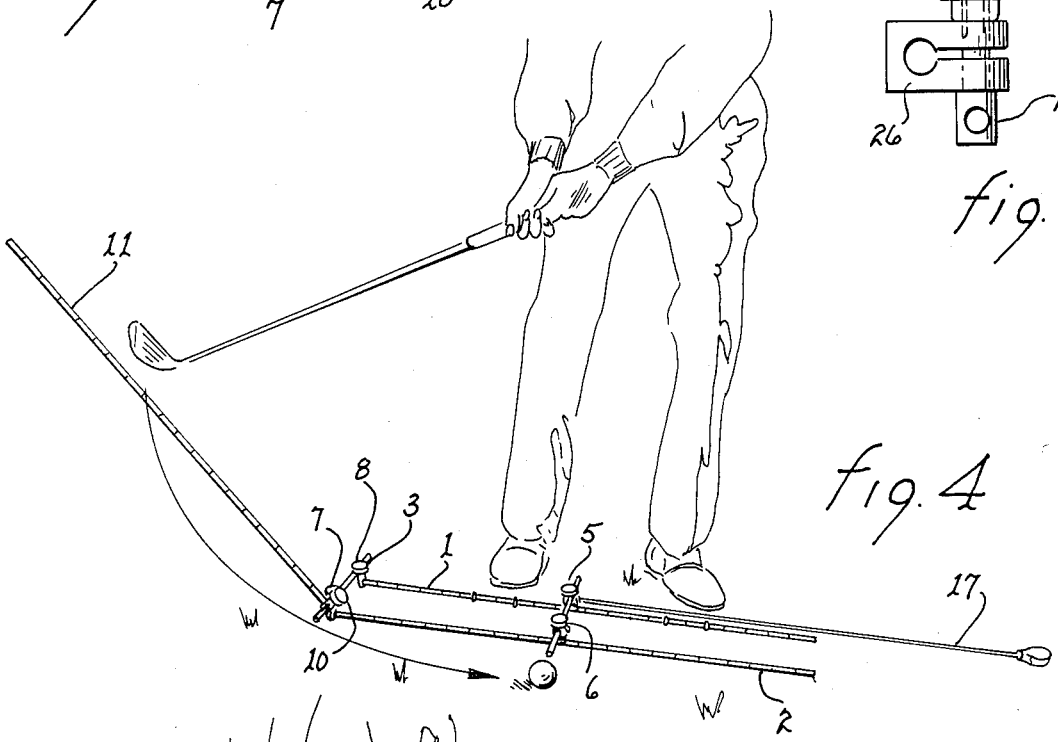
FIG. 4 is a front planer view showing the golf stance and swing practice device set up for executing chips and pitch shots.

FIG. 4 is a front planar view showing the golf stance and swing practice device set up for executing chips or pitch shots.

The foot position indicator markings 9 are slidably mounted to the first linear frame member 1 to indicate the proper stance for executing a particular stroke. The ball placement indicator 4 denotes the position at which the ball should be placed between the golfer's feet for executing a particular stroke.

The vertical linear bar 11 with graduated markings is adjustable to create a vertical angle of any specific degree to the ground for use in establishing a correct target line for a golf shot which would be parallel to the bar in vertical plane and for use in indicating the proper degree of stroke for hitting a golf ball any specific distance.

Figure 5:
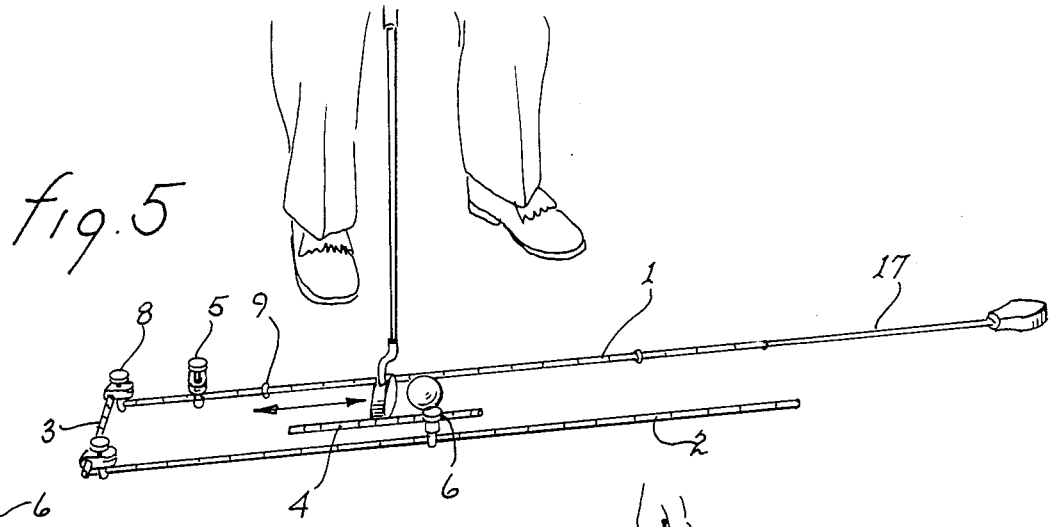
FIG. 5 is a front planer view showing the golf stance and swing practice device set up for executing putts.

FIG. 5 is a front planar view of the golf stance and swing practice device set up for executing putts. To execute putts the foot position indicator markings 9 are slidably attached to the first graduated linear frame member 1 to indicate the proper positioning of the golfer's feet. To execute putts, linear frame member 4 is rotated to parallel linear frame member 2. The degree of stroke necessary to properly execute a putt of any specific distance can be judged from the length of stroke indicated by the graduated markings on linear frame member 4.

Figure 6:
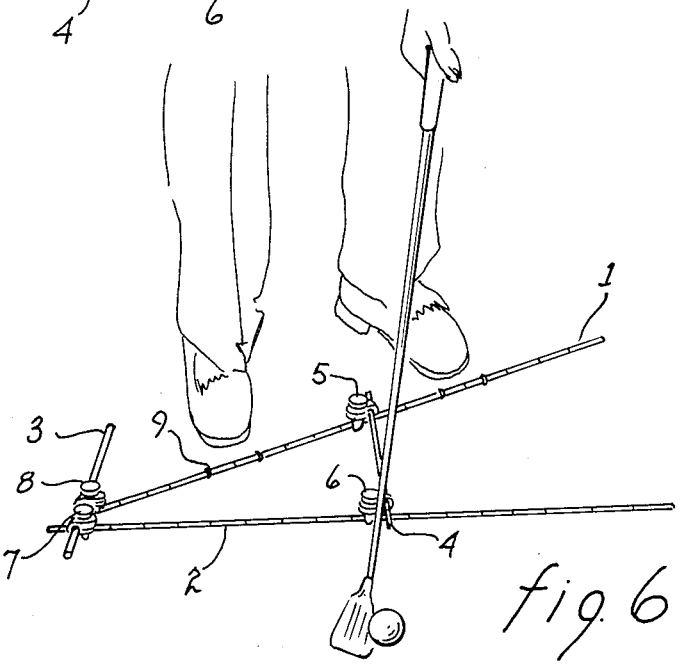
FIG. 6 is a front planer view of the golf stance and swing practice device set up for making open stance shots.

FIG. 6 is a front planar view of the golf stance and swing practice device set up for executing open stance shots. The foot position indicator markings 9 are slidably attached to linear frame member 1 to indicate the proper positioning of the golfer's feet. Graduated linear frame member 4 denotes the position at which the ball should be placed between the golfer's feet for executing the shot.

Figure 7:
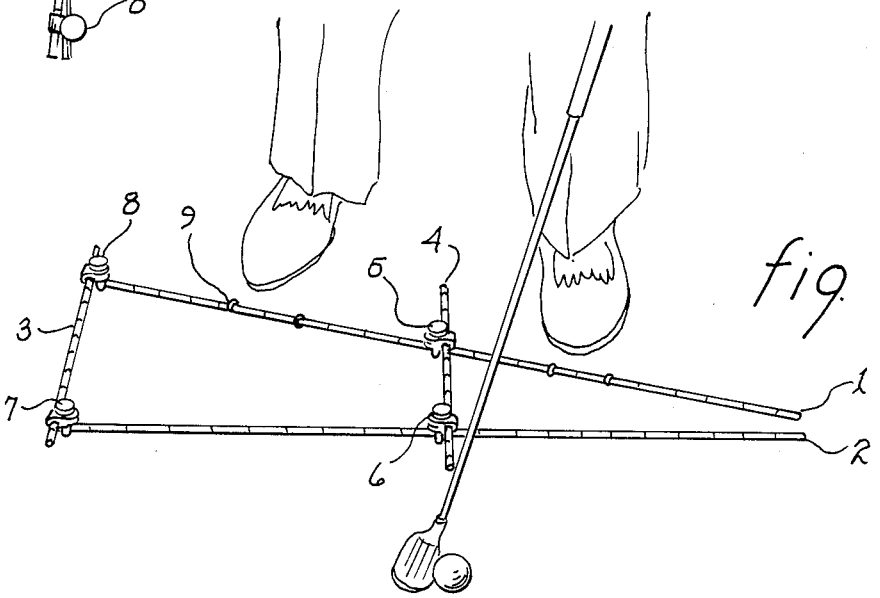
FIG. 7 is a front planer view of the golf stance and swing practice device set up for making closed stance shots.

FIG. 7 is front planar view of the golf stance and swing practice device set up for executing open stance shots. The foot position indicator markings 9 are slidably attached to the first linear frame member 1 to indicate the proper positioning of the ball position indicator 4 denotes the position of which the ball should be placed between the golfer's feet for executing the shot.

Figure 8:
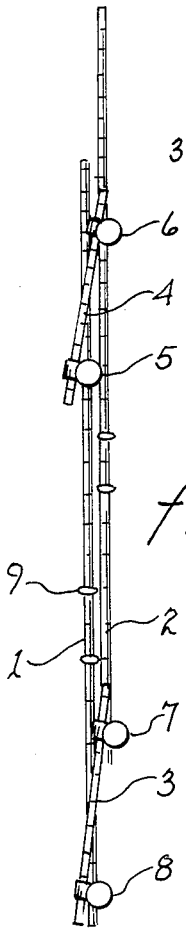
FIG. 8 is a front planar view of the golf stance and swing practice device folded so as to fit into a golfer's bag.

FIG. 8 is a top view of the golf stance and swing practice device folded so as to fit into a golfer's bag.

What is claimed is:

1. A golf stance and swing practice device for use in positioning a golfer in proper relation to a golf ball for lining up a golf shot and for judging the proper degree of stroke for hitting a golf ball any specific distance within the golfer's skill level comprising:

means including a plurality of linear frame members for positioning a golfer in proper relation to a golf ball for properly positioning said golf ball for lining up any golf shot, each of said plurality of linear frame members has graduated markings along its length;

means including a graduated linear bar for establishing the correct target line for a golf shot, said graduated linear bar having adjustment means coupled thereto for creating a vertical angle of any specific degree relative to the ground;

means including a plurality of rotatable connectors for joining together each of said plurality of linear frame members;

means including a single rotatable connector for rotatably connecting one of said plurality of linear frame members to said graduated linear bar; and means including a plurality of foot position markers for providing an indication of where to properly position the golfer's feet for any particular stroke.

2. The golf stance and swing practice device as in claim 1 wherein each of said plurality of rotatable connectors comprises swivel clamps.

3. The golf stance and swing practice device as in claim 2 wherein said single rotatable connector comprises a swivel clamp.

4. The golf stance and swing practice device as in claim 3, wherein said foot position markers are slidably attached to one of said plurality of linear frame members.

* * * * *